US007051559B1

(12) United States Patent
Hollis

(10) Patent No.: US 7,051,559 B1
(45) Date of Patent: May 30, 2006

(54) MESSAGE DELIVERY ASSEMBLY AND A METHOD FOR CONDUCTING BUSINESS USING THE MESSAGE DELIVERY ASSEMBLY

(76) Inventor: Michelle M. Hollis, 7867 Rutherford Ct., Canton, MI (US) 48187

( * ) Notice: Subject to any disclaimer, the term of this patent is extended or adjusted under 35 U.S.C. 154(b) by 0 days.

(21) Appl. No.: 10/234,487

(22) Filed: Sep. 3, 2002

(51) Int. Cl.
*E05B 65/52* (2006.01)

(52) U.S. Cl. ..... 70/63; 24/303; 70/276; 70/DIG. 81; 109/47; 220/483; 446/369; 446/390

(58) Field of Classification Search ..... 70/63, 70/276, DIG. 81; 109/47; 220/483; 446/369, 446/370, 390; 24/303; 292/251.5; 63/900, 63/1.11, 1.12, 1.14, 1.18
See application file for complete search history.

(56) References Cited

U.S. PATENT DOCUMENTS 2,304,415 A * 12/1942 Lawson, Sr. ..... 446/9
3,044,232 A * 7/1962 Robichaud ..... 53/254
3,871,284 A * 3/1975 Krise ..... 109/59 R
4,157,630 A * 6/1979 Sawai ..... 446/9
4,260,180 A * 4/1981 Halushka et al. ..... 285/9.1
4,742,500 A * 5/1988 Luce ..... 368/10
4,901,462 A * 2/1990 Wrigley ..... 40/665
5,060,491 A * 10/1991 Smith ..... 70/63
5,168,734 A * 12/1992 Duval et al. ..... 70/369
5,186,350 A * 2/1993 McBride ..... 220/739
5,807,155 A * 9/1998 Divvleeon ..... 446/73
6,264,055 B1 * 7/2001 Dozier ..... 220/483
6,640,398 B1 * 11/2003 Hoffman ..... 24/303
6,651,470 B1 * 11/2003 Rafter ..... 70/395
6,848,288 B1 * 2/2005 Derman ..... 70/459

* cited by examiner

*Primary Examiner*—Lloyd A. Gall
(74) *Attorney, Agent, or Firm*—Law Offices of John Chupa & Associates, P.C.

(57) ABSTRACT

A message delivery assembly (10) and a method for conducting business (400) using the message delivery assembly (10) which has an exterior (12) in the shape of a Teddy-bear or substantially any other desired shape. Particularly, the message delivery assembly (10) includes a containment cavity (40) which frictionally receives a generally hollow cylinder (50) which is selectively lockable within the containment cavity (40) by use of a key (70), and which contains a personal message (90) from a user which is delivered to an intended recipient in a relatively secure and convenient manner.

12 Claims, 5 Drawing Sheets

MESSAGE DELIVERY ASSEMBLY AND A METHOD FOR CONDUCTING BUSINESS USING THE MESSAGE DELIVERY ASSEMBLY

FIELD OF THE INVENTION

The present invention generally relates to a message delivery assembly and a method for conducting business using the message delivery assembly, and more particularly, to a bear shaped message delivery assembly having a lockable message containment cavity and a method for conducting business using the bear shaped delivery assembly by use of a computer based internet web site which allows an individual to order a bear shaped message delivery assembly, author a personal message to be included within the bear shaped message delivery assembly, and pay for the bear shaped message delivery assembly and the delivery of the bear shaped message delivery assembly, in a convenient manner.

BACKGROUND OF THE INVENTION

Oftentimes, it is desirable to send an individual a personal message by use of a "non-ordinary" or an unconventional means or method in order to surprise the individual or to "brighten" the individual's day or spirit. By way of example and without limitation, prior "unconventional" means of sending a message to another individual include sending flowers with an attached card, sending a balloon and a card, or sending an individual a "singing-telegram". Although these known methodologies do desirably relay a message to another individual, they do not allow the individual to preserve the memory of the delivered message with a memento which does not eventually fade (e.g., flowers eventually die, balloons eventually deflate and/or pop, and singing telegrams last only as long as the singer is singing the telegram).

One known methodology, for example and without limitation, for sending an individual a surprise gift or memento is the methodology of ordering a Teddy-bear or stuffed animal by use of the Internet. This known methodology allows a customer to order a customized Teddy-bear and send this customized Teddy-bear to another individual. Although this methodology does desirably provide a memento, it does suffer from a major drawback. For example and without limitation, this methodology does not allow a customer to send a personalized message to the individual whom the Teddy-bear was intended for.

Furthermore, it is oftentimes desirable to send another individual a "secure" message which cannot be read by an individual whom the message was not intended for. Prior methodologies for sending a secured message include, by way of example and without limitation, sending another individual a secured e-mail, sending another individual a message which requires the intended recipient of the message to provide identification and a signature before the message is delivered (e.g., any form of certified mail), or personally delivering an individual a message in order to avoid having the message read or intercepted by another individual other than the intended recipient.

Although these prior methods do desirably allow for the sending and receiving of a secure message, they do suffer from some drawbacks. For example and without limitation, sending an individual a secure e-mail does not allow the sender of the e-mail to include a gift or a memento which is not in the form of text or electronic messages. Moreover, sending an individual a piece of certified mail forces the intended recipient to produce and show identification as well as provide a signature, which may undesirably inconvenience the intended recipient or simply lessen or trivialize the intended personal message or surprise. Furthermore, personally delivering a message to the intended recipient requires the deliverer to travel to a location which may not be physically possible if the intended recipient is in a remote location such as a different state or country. Furthermore, sending an individual a Teddy-bear does not allow for a personalized message and, if a card could be included with the Teddy-bear, this method would still lack the secure personalized message delivery nature that is oftentimes desirable.

There is therefore a need for a method which allows an individual to send another individual a secure message in a convenient manner. There is also a need for a method for providing the intended recipient of the secure message with a memento which serves to preserve the memory and surprise of the occasion, which overcomes some or all of the previously delineated drawbacks of prior message delivery methodologies.

SUMMARY OF THE INVENTION

A first non-limiting advantage of the present invention is that it provides a message delivery assembly which overcomes some or all of the previously delineated drawbacks of prior message delivery assemblies.

A second non-limiting advantage of the present invention is that it provides a message delivery assembly which overcomes some or all of the previously delineated drawbacks of prior message delivery assemblies and a method for conducting business using the message delivery assembly.

A third non-limiting advantage of the present invention is that it provides a message delivery assembly which has a lock and a key which cooperates with the lock to allow the intended recipient of the assembly to selectively open or remove a portion of the assembly and close or return a portion of the assembly.

A fourth non-limiting advantage of the present invention is that it provides an assembly comprising a body having a containment cavity; a generally hollow cylinder which is selectively inserted into and frictionally fit with the containment cavity; a message which is removably inserted into the cylinder; and a member which is selectively coupled to the cylinder and which is effective to selectively remove the generally hollow cylinder from the containment cavity.

A fifth non-limiting advantage of the present invention is that it provides a message delivery assembly. Particularly, the message delivery assembly comprises a body which is shaped as a bear, the body having a head portion, a torso portion, a pair of arms, and a pair of legs, the torso portion having a containment cavity which extends from between the pair of legs to the center of the torso portion; a generally hollow cylinder which is removably inserted into the containment cavity, the generally hollow cylinder having a threaded aperture, a threaded aperture cover which cooperates with the threaded aperture, and a locking assembly; a message which is removably inserted into the generally hollow cylinder through the threaded aperture; a key comprising a first end which cooperates with the locking assembly to allow removal of the generally hollow cylinder from the containment cavity and a second end of a certain shape; and a fastening assembly which selectively and removably holds the key to the torso portion.

A sixth non-limiting advantage of the present invention is that it provides a method for conducting business using a message delivery assembly. Particularly the method comprises the steps of: providing a stuffed animal having an internal containment cavity and a cylinder; taking an order from a customer to supply a message and a stuffed animal to another individual and collecting payment from said customer; removably placing said customer supplied message from said customer within said cylinder; disposing said cylinder within said internal containment cavity of said stuffed animal; locking said cylinder within said internal containment cavity; providing a key which unlocks said cylinder from said internal containment cavity; and delivering said stuffed animal and said key to said individual.

These and other features and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
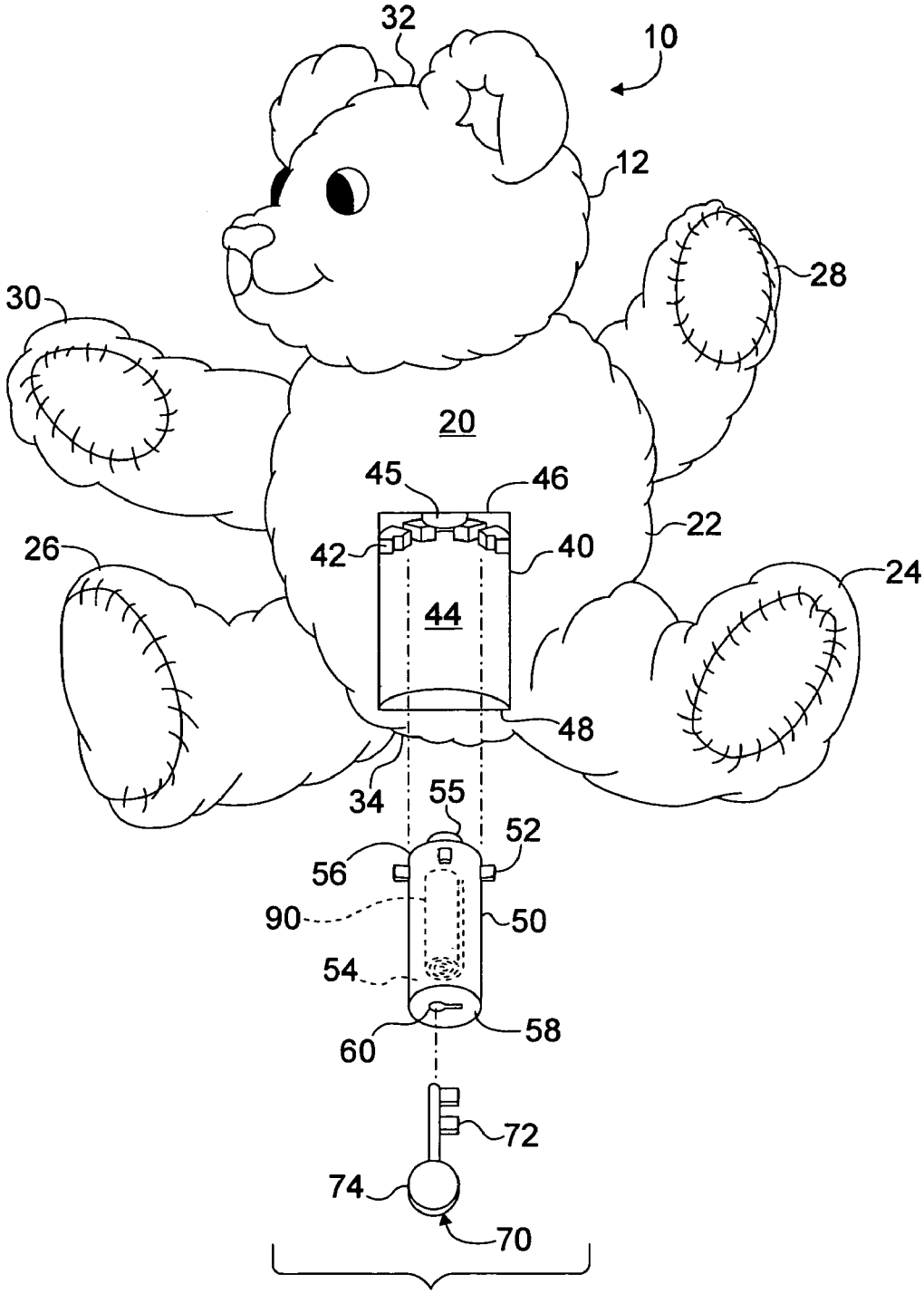
FIG. 1 is a partial cut-away perspective view of a message delivery assembly which is made in accordance with the teachings of the preferred embodiment of the invention.
Figure 2:
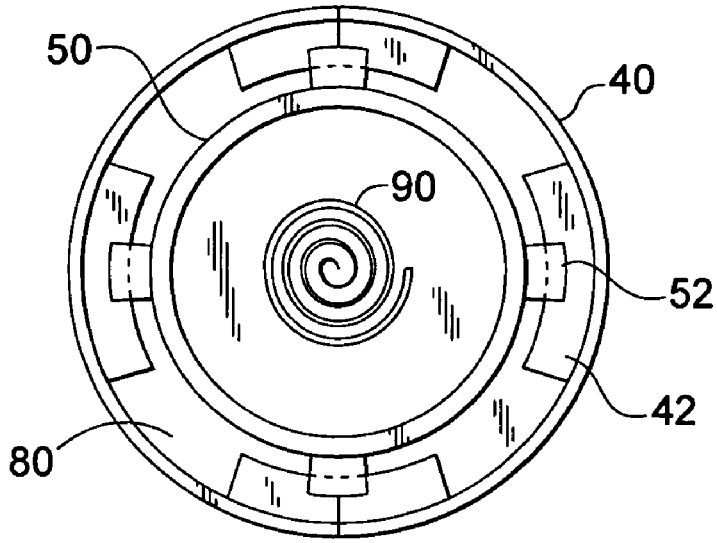
FIG. 2 is a top view of the containment cavity coupled to the generally hollow cylinder.
Figure 3:
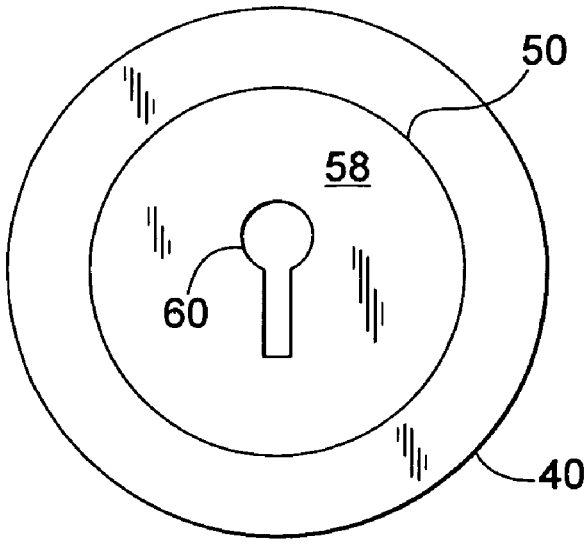
FIG. 3 is a bottom view of the containment cavity coupled to the generally hollow cylinder.

Referring now to FIGS. 1–3, there is shown a message delivery assembly 10 which is made in accordance with the teachings of the preferred embodiment of the invention. As shown, message delivery assembly 10 includes a generally "bear-shaped" or "Teddy-bear" exterior or form 12 having a body portion 20. Body portion 20 includes a pair of hind legs or "legs" 24, 26, a pair of fore-legs or "arms" 28, 30, and a head 32. Body portion 20 further includes a generally hollow containment cavity 40 which is generally tubular in shape and which is fixedly coupled to and disposed within the exterior form 12 between the legs 24, 26 and extending from the anus 34 of the body portion 20 to approximately one-half to about three-quarters of the body portion 20 in the direction of the head 32 (i.e., the containment cavity 40 extends from the anus 34 to approximately the middle of the body portion 20). In one non-limiting embodiment, a flap or piece of fabric, which is substantially similar to the fabric which assembly 10 is covered with, may cover the anus 34, effective to substantially hide the containment cavity 40 and the anus 34. It should be appreciated that the containment cavity 40 may be repositioned to substantially any desired position within the exterior 12. Containment cavity 40 further includes at least one inwardly projecting fastening tab 42 which projects within the generally hollow area 44 of containment cavity 40.

At the outset, it should be understood that the form 12 of message delivery assembly 10 is not limited to the shape or general form of a Teddy-bear. Rather, there is a plurality of shapes and forms of animals or objects which may be used (e.g., in the place of the Teddy-bear form) for various special occasions and holidays. For example and without limitation, the general shape or form of a duck or an Easter Bunny (not shown) may be utilized on a holiday such as Easter. In further example and without limitation, message delivery assembly 10 may be constructed out of a material which may be sculpted (e.g., ceramic, stone, resin, clay, or the like). In this manner, message delivery assembly 10 may comprise a statue, a center piece, a garden decoration, or the like. It should be appreciated that, in this non-limiting example, the message delivery assembly 10 may be used as a decorative piece after the assembly 10 has been delivered and after the recipient of assembly 10 has read his/her message.

Apparatus 10 further includes a generally hollow cylinder 50 which is tubular in shape and which is also shaped to frictionally fit within the generally hollow area 44 of containment cavity 40. Generally hollow cylinder 50 further includes a first open end 56 and a second closed end 58 having a blind aperture 60 which cooperates with a key 70 to lock and unlock the generally hollow cylinder 50 from the containment cavity 40 and which will be explained below in greater detail.

First open end 56 further includes at least one outwardly projecting fastening tab 52 which cooperates with the at least one inwardly projecting fastening tab 42 of containment cavity 40 to selectively, hold or contain the generally hollow cylinder 50 within the containment cavity 40. As best shown in FIG. 2, the gap or empty space 80 along either side of the at least one projecting fastening tab 42 allows the selective removal of the generally hollow cylinder 50 from the containment cavity 40. That is, with cooperation of the key 70, a user may selectively turn the generally hollow cylinder 50 within the containment cavity 40, effective to either secure the at least one outwardly projecting fastening tab 52 above the at least one inwardly projecting fastening tab 42 or effective to turn the generally hollow cylinder 50 within the containment cavity 40 in order to selective move the at least one outwardly projecting fastening tab 52 from above the at least one inwardly projecting fastening tab 42 into an open space 80 which allows the removal of the generally hollow cylinder 50 from the containment cavity 40.

As shown in FIGS. 1 and 2, the generally hollow cylinder 50 further includes a message 90 which is removably disposed within the generally hollow area 54 of generally hollow cylinder 50. It should be understood that nothing in this description is meant to limit the contents of generally hollow cylinder 50 to a message 90. Rather, generally hollow cylinder 50 may contain substantially any desired form of message (e.g., a personal web site address, a telephone number, a small cassette, a gift certificate, or the like) or small object (e.g., candy, jewelry, or the like). Furthermore, it should be understood to one who is skilled in the relevant art, that the architecture, shape, and/or geometry of the containment cavity 40 and the generally hollow cylinder 50 may be of substantially any desired shape or desired size, and nothing in this description is meant to limit the size of the containment cavity 40 or the size of the generally hollow cylinder 50.

In one non-limiting embodiment, the containment cavity 40 may employ a magnet 46 operatively disposed upon the top portion (i.e., the end of the cylinder which is closed) of the containment cavity 40 and the generally hollow cylinder 50 may be constructed, in part, of a metal material. In this manner, the magnet 46 of the containment cavity 40 will attract the metal of generally hollow cylinder 50 and act as a fastening device, effective to allow containment cavity 40 to operatively and removably contain the generally hollow cylinder 50. It should be appreciated that, in this non-limiting embodiment, nothing in this description is meant to limit the location of the magnet or the location of the metal. Rather, the magnet may be operatively disposed upon or within the generally hollow cylinder 50 and the containment cavity may be at least partially constructed out of metal. Furthermore, both the containment cavity 40 and the generally hollow cylinder 50 may each contain a magnet 45, 55, respectively, such that one magnet is positioned oppositely (i.e., the poles of the respective magnets are opposite) in respect to the other magnet in order to effectuate a magnetic attraction (i.e., each magnetic pole of a magnet is attracted to an opposite magnetic pole of another magnet), thereby obviating any metal material within or upon the generally hollow cylinder 50 or the containment cavity 40. It should be understood to one who is skilled in the relevant art that the magnets 45, 55 and the fastening tabs 42, 52 may be employed to cooperatively contain the generally hollow cylinder 50 within the containment cavity 40 or either the fastening tabs 42, 52 or the magnets 45, 55 may be removed. In this manner, the generally hollow cylinder 50 may be contained within the containment cavity 40 solely by the use of the magnets 45, 55 or solely by the use of the fastening tabs 42, 52.

Figure 4:
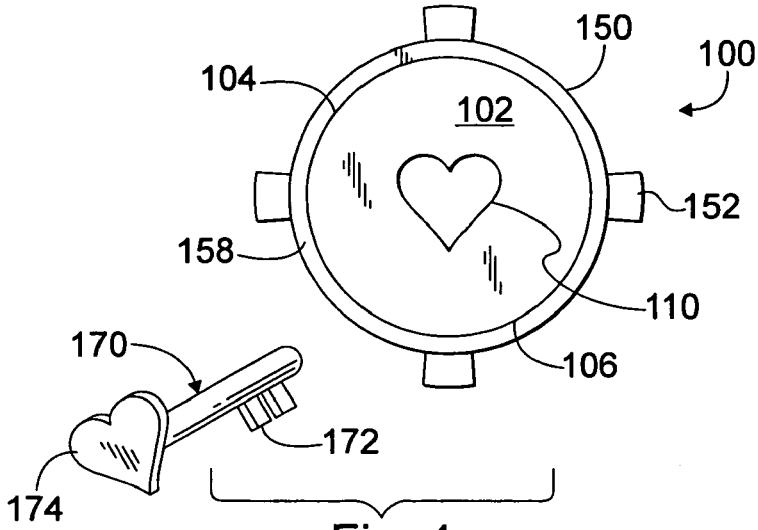
FIG. 4 is a top view of an alternate embodiment of the invention in combination with a key.
Figure 5:
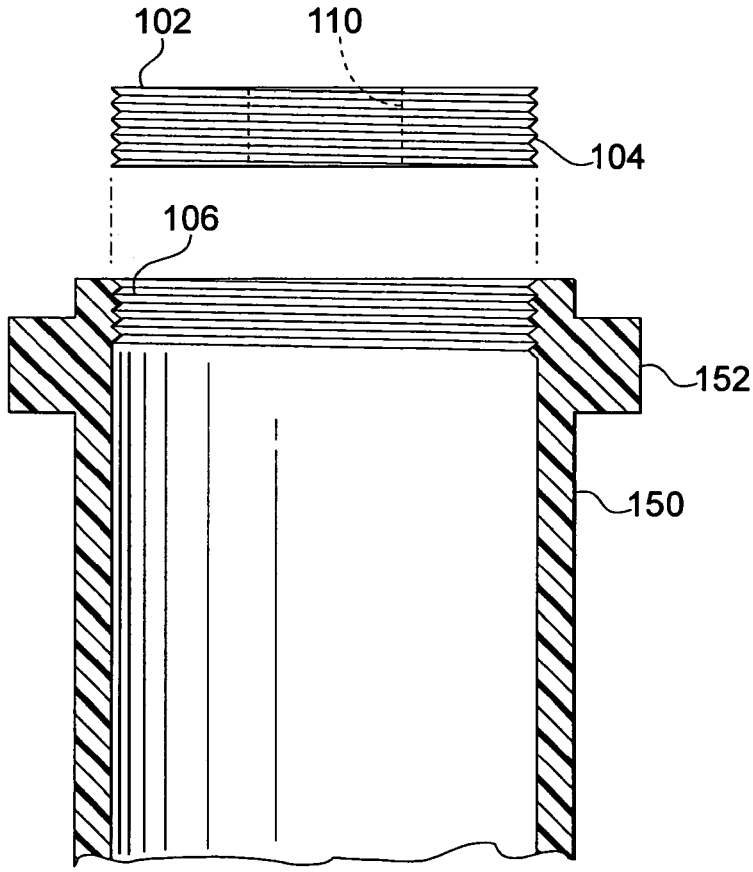
FIG. 5 is a side cut away view of the alternate embodiment which is shown in FIG. 4.

Referring now to FIGS. 4 and 5, there is shown an alternate embodiment of the generally hollow cylinder 50. As shown, generally hollow cylinder 100 includes a cylinder portion 150 and a selectively removable portion or lid 102 having threading 104 which is located on the outer periphery of the lid 102 and a recessed portion 110 which is substantially heart-shaped. The cylinder portion 150 includes a top portion 158 having at least one outwardly projecting fastening tab 152 which is substantially identical to the outwardly projecting fastening tab 52 of generally hollow cylinder 50. Cylinder portion 150 further includes threading 106 which is located upon the inner periphery of the top portion 158. In this alternate "threaded lid" embodiment, a key 170 having a first end 172 and a second end 174, which is shaped to frictionally fit within the heart shaped depression 110, is used as a tool to not only allow the removal of the cylinder 150 from the containment cavity 40, but the second and heart-shaped end 174 of key 170 also serves to couple and uncouple the selectively removable lid 102 from the generally hollow cylinder portion 150. In this manner, a user may remove the generally hollow cylinder 100 from the containment cavity 40 by the use of the first end 172 of key 170 (i.e., the first end 172 frictionally fits into the aperture 60 which then allows a user to turn the generally hollow cylinder 100 into a position in which the at least one outwardly projecting fastening tab 152 enters the open space 80). Upon removal of the cylinder 100, a user may then frictionally couple the heart shaped end 174 of key 170 into the heart shaped depression 110 and utilize the key 170 as a conventional screwdriver to selectively uncouple the lid 102 from the generally hollow cylinder portion 150. It should be understood that nothing in this description is meant to limit the shape of the second end 174 of key 170 to a heart. It should be further understood that nothing in this description is meant to limit the depression 110 to the shape of a heart. Rather, as should be apparent to one who is skilled in the relevant art, there are a plurality of applicable shapes which may be employed within the lid 102 which may be frictionally fit and uncoupled or coupled to and/or from the generally hollow cylinder portion 150 by a substantially identical shape of a second end 174 of key 170. For example and without limitation, lid 102 may employ a star shaped depression (not shown) and the second end 174 of key 170 may be shaped substantially identical to the star shaped depression (not shown). It should be appreciated that, in this manner, the assembly 10 employs both a first form of security (i.e., the first end 172 of key 170 cooperating with the blind aperture 60 to allow removal of the generally hollow cylinder 100) and a second form of security (i.e., the selectively removable lid 102 and the depression 110 in cooperation with the second end 174 of key 170 to allow the uncoupling of lid 102 from the generally hollow cylinder portion 150) that only an authorized user (i.e., the intended recipient of the assembly 10 having the proper key 170) may overcome in order to acquire or read the message 90 which is encapsulated within the generally hollow cylinder 150. It should be understood that the remaining portion of cylinder 150 which is not shown in FIG. 5 is substantially identical to the corresponding portion of generally hollow cylinder 50 which is shown in FIG. 1.

In one non-limiting embodiment of the invention, the generally hollow cylinder 50 may employ a conventional three or four digit combination locking device (not shown) and the intended recipient of the message delivery assembly 10 may receive the proper combination to unlock the conventional combination locking device. In this manner, the key 70, 170 may be obviated. It should be appreciated that, in this non-limiting embodiment, the conventional combination locking device may either be operatively disposed upon the generally hollow cylinder 50 or upon the containment cavity 40, thereby also providing a means for containment cavity 40 to operatively contain the generally hollow cylinder 50.

Figure 6:
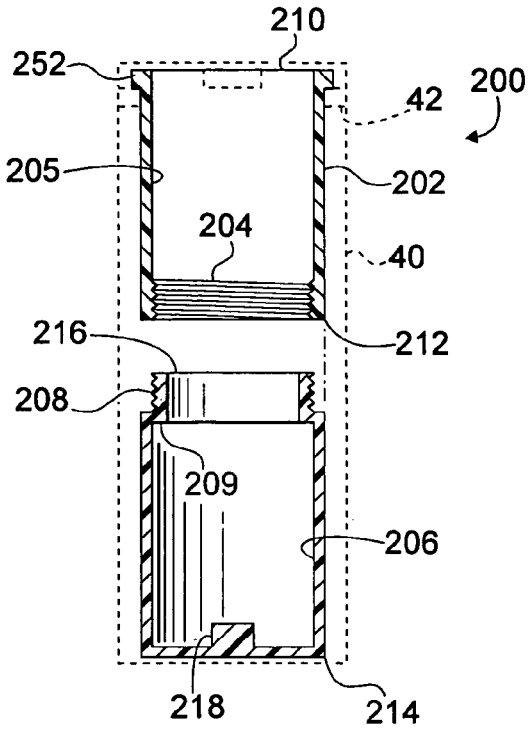
FIG. 6 is a side cut away view of yet another alternate embodiment of the invention.

Referring now to FIG. 6, there is shown yet another alternate embodiment of the generally hollow cylinder 50. As shown, generally hollow cylinder 200 includes a first half 202 having a first closed end 210 and a second open end 212 having threading 204 on the inner periphery 205 of the open end 212. First closed end 210 of first half 202 further includes at least one outwardly projecting fastening tab 252 which is substantially identical to the at least one outwardly projecting tabs 50, 150 of generally hollow cylinders 52, 152.

Generally hollow cylinder 200 further includes a second half 206 having a third closed end 214 and a fourth open end 216 having threading 208 on the outer periphery 209 of the open end 216. It should be understood to one who is skilled in the relevant art that threading 208 is complementary to threading 204 (i.e., threading 208 cooperates with threading 204 to couple and uncouple the first half 202 from or to the second half 206). The fourth closed end 214 of second half 206 further includes a blind aperture 218 which is substantially identical to the blind aperture 60 of generally hollow cylinder 50. It should be understood that, with the above described architecture of this "first and second half" embodiment, a user may selectively remove the generally hollow cylinder 200 from the containment cavity 40 in substantially the same manner as discussed above in the preferred embodiment. Upon removal of the generally hollow cylinder 200 from the containment cavity 40, a user may selectively uncouple and couple the first half 202 from and to the second half 206 in a well known and conventional manner (e.g., by simply spinning the first half 202 in an opposite direction as the second half 206).

Figure 7:
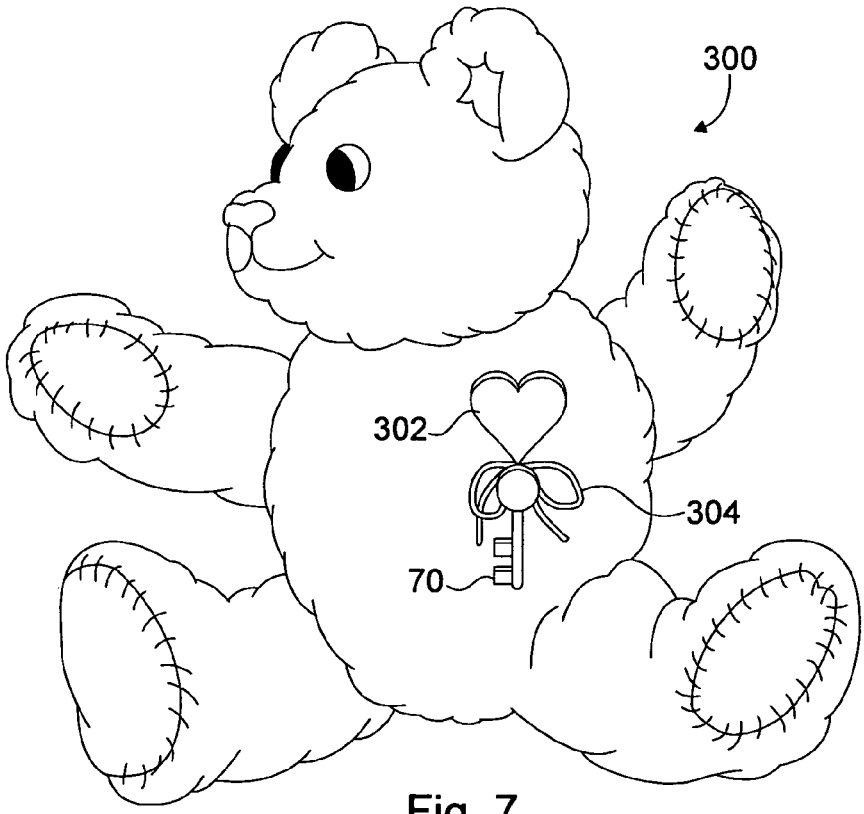
FIG. 7 is a perspective view of yet another alternate embodiment of the invention.

Referring now to FIG. 7, there is shown an alternate embodiment of message delivery assembly 10. As shown, message delivery assembly 300 is substantially similar to the message delivery assembly 10 of the preferred embodiment, however message delivery assembly 300 further includes a decorative heart design 302 which is coupled to the body portion of the assembly 300. It should be understood that the decorative heart design 302 may be one or a compilation of a multitude of materials and that nothing in this description is meant to limit the heart shaped design 302 to any particular material. For example and without limitation, heart design 302 may comprise a metal material which, in one non-limiting embodiment, may be selectively engraved with a slogan, a name, or the like. In yet another alternate embodiment, the decorative heart design 302 may comprise a conventional locket which may be selectively removable and which may contain a picture or an engraving. In further example and without limitation, heart design 302 may comprise a fabric material which, in one non-limiting embodiment, may be selectively embroidered with a slogan, a name, or the like.

Decorative heart design 302 further includes a fastening device 304 which is attached to the decorative heart design 302. Fastening device 304, in one non-limiting embodiment, may comprise a certain length of decorative lace or ribbon which may be decoratively tied around the key 70. In an alternate embodiment of the invention, the fastening device 304 may comprise a conventional decorative clasp (e.g., a jewelry or necklace clasp), a key chain, a necklace, a magnet, or the like, which may selectively hold the key 70 to the heart design 302. In yet another alternate embodiment, the assembly 10 may have a ribbon (not shown) which may be hung upon the upper area of body portion 20 and around the head 32 of the assembly 10. This ribbon may further comprise a heart shaped design (not shown) which is substantially similar to the heart shaped design 302. Further, the key 70, in this alternate embodiment, may be attached to the heart shaped design in a conventional manner or in a manner which is substantially similar to the above described manner (i.e., a ribbon, a key chain, a necklace, a jewelry clasp, a magnet, or the like).

In operation and in combination with a conventional computer having Internet access, a user that desires to send a message 90 to another individual, may gain access to a web-site which is designed to allow a user to order a message delivery assembly 10, author a personal message 90 (i.e., enter certain information which pertains to a personalized message, the name of the individual to whom the assembly 10 is to be delivered to, who is sending the personalized message and assembly 10 to the intended recipient, and which assembly 10 the user desires to send) to be included within the message delivery assembly 10, and pay for the message delivery assembly 10 and the delivery of message delivery assembly 10 (e.g., credit card information of the user which allows and authorizes the individual or business enterprise who is/are selling assembly 10 to charge the credit card of the user in order to pay for the assembly 10 and the delivery of assembly 10). It should be understood that nothing in this description is meant to limit the ordering means of an assembly 10 to only a computer system. Rather, assembly 10, in alternate embodiments, may be ordered in person or by utilizing a conventional telephone, a conventional letter, or the like.

Once the user has finished entering the certain information, the user simply pays for the assembly 10 and the delivery of assembly 10. Upon payment, the individual or business enterprise which provides the assembly 10 and delivery service of assembly 10 then downloads the certain entered information from the web-site of the individual or business enterprise and places the personal message 90 within the generally hollow cylinder 50, places the generally hollow cylinder 50 within the containment cavity 40, places the key 70 within the blind aperture 60, and turns the key 70 to lock the generally hollow cylinder 50 within the containment cavity 40. The individual or business enterprise then removably affixes the intended recipient's delivery address to the assembly 1 (or upon or within a box in which assembly 10 will be placed) along with a brief description or directions on how the intended recipient may gain access to the personal message 90 and delivers the assembly 10 to the desired recipient in a conventional manner. In an alternate embodiment of the invention, the individual or business enterprise may deliver the key 70 to the intended recipient prior to delivering the assembly 10. In this manner, the individual or business enterprise may request the recipient for proper identification while concomitantly preserving the intended surprise of the message delivery assembly 10. Furthermore, in this manner, the individual or business enterprise can ensure that only the intended recipient will have access to the assembly 10 and the message 90 contained therein.

Figure 8:
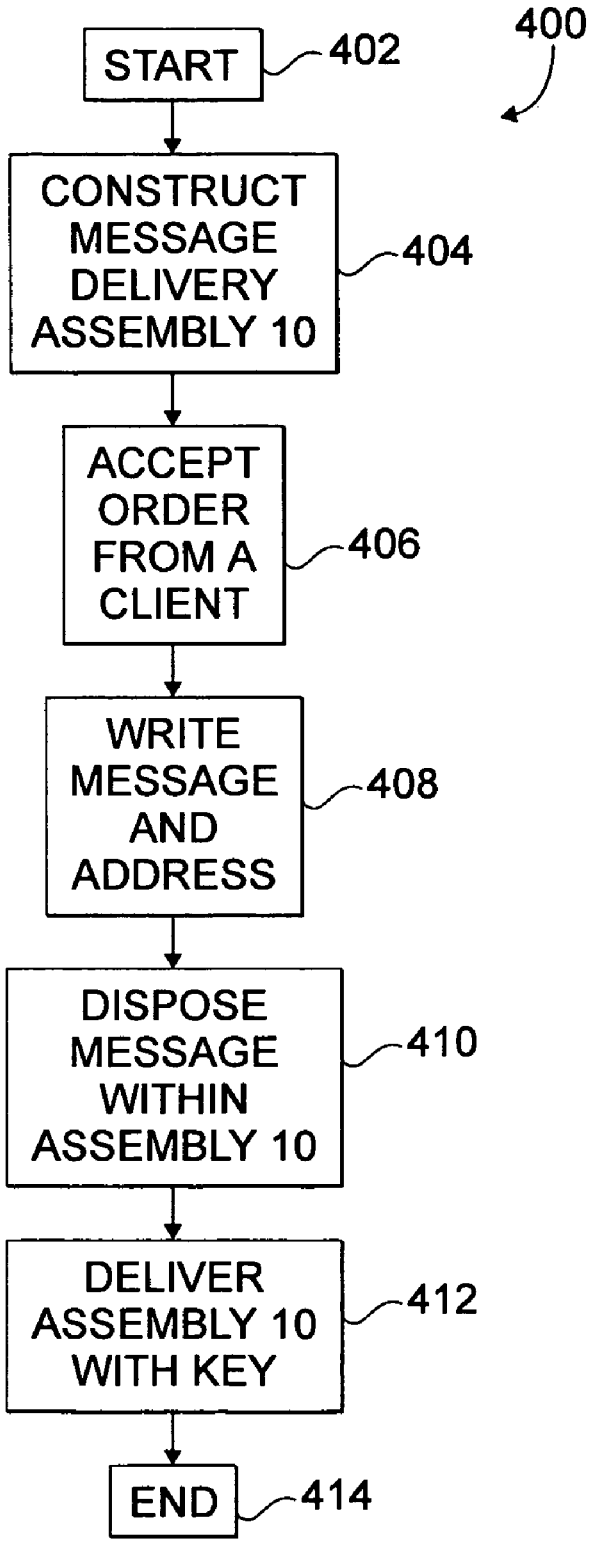
FIG. 8 is a flowchart of the preferred methodology of the present invention.

Referring now to FIG. 8, there is shown a methodology 400 for conducting business using the message delivery assembly 10. As shown, methodology 400 begins with the step 402 in which the methodology 400 is started. Step 404 follows step 402, and in this step 404, the individual or business enterprise will construct or provide the message delivery assembly 10. Step 406 follows step 404, and in this step 406, the individual or business enterprise will accept an order from an individual client who desires to have both a personal message 90 and an assembly 10 delivered to another individual. Step 408 follows step 406, and in this step 408 the individual will write, print, or record the client's personal message, write or print the client's name, write or print the intended recipient's mailing address, and accept payment from the client for the business enterprise's or individual's service. Step 410 follows step 408, and in this step 410 the individual or business enterprise disposes the message 90 within the generally hollow cylinder 50 and locks the generally hollow cylinder 50 within the containment cavity 40 by use of key 70. Step 412 follows step 410, and in this step 412 the individual or business enterprise delivers the assembly 10 containing the message 90 and the key 70 to the intended recipient at the client provided intended recipient's mailing address. Step 414 follows step 412, and in this step 414 the methodology is finished or has ended.

It should be understood that this invention is not limited to the exact construction or embodiments listed and described, but that various changes may be made without departing from the spirit and scope of the invention. For example and without limitation, the containment cavity 40 may be replaced with a fabric pocket which fastens together in a conventional manner (e.g., by use of a hook and pile assembly which may be sold under the registered trademark Velcro®, a conventional zipper and zip assembly, magnetic device, or substantially any desired commercially available and/or conventional fastening assembly).

What is claimed is:

1. An assembly comprising:

a body having a containment cavity;

a generally hollow cylinder which is selectively inserted into and frictionally fit with said containment cavity;

a message which is removably inserted into said cylinder; and a member which is selectively coupled to said cylinder and which is effective to selectively lock said generally hollow cylinder within said containment cavity and selectively remove said generally hollow cylinder from said containment cavity, wherein said containment cavity further comprises a first magnet utilizing a negative magnetic pole, and wherein said generally hollow cylinder further comprises a second magnet utilizing a positive magnetic pole, said first magnet attracting said second magnet, thereby causing said generally hollow cylinder to be removably contained within said containment cavity.

2. The assembly of claim 1 wherein said containment cavity further comprises at least one inwardly projecting fastening tab.

3. The assembly of claim 2 wherein said generally hollow cylinder further comprises at least one outwardly projecting fastening tab, said outwardly projecting fastening tab cooperating with said inwardly projecting fastening tab to selectively and removably couple said cylinder within said containment cavity.

4. The assembly of claim 1 wherein said cylinder further comprises a locking assembly.

5. The assembly of claim 4 wherein said member is a key and wherein said key further comprises a first end and a second end which is heart shaped.

6. The assembly of claim 5 wherein said locking assembly cooperates with said first end of said a key to allow access to said message.

7. An assembly comprising:

a body having a containment cavity;

a generally hollow cylinder which is selectively inserted into and frictionally fit with said containment cavity;

a message which is removably inserted into said cylinder; and a member which is selectively coupled to said cylinder and which is effective to selectively lock said generally hollow cylinder within said containment cavity and selectively remove said generally hollow cylinder from said containment cavity, wherein said cylinder further comprises:

a first half having a first closed end and a second opened and threaded end; and a second half having a first closed end and a second opened and threaded end, said second open threaded end of said second half cooperating with said second open threaded end of said first half, effective to selectively and removably couple said first half to said second half.

8. A message delivery assembly comprising:

a body which is shaped as a bear, said body having a head portion, a torso portion, a pair of arms, and a pair of legs, said torso portion having a containment cavity which extends from between said pair of legs to the center of said torso portion;

a generally hollow cylinder which is removably inserted into said containment cavity, said generally hollow cylinder having a first and second half, wherein said cylinder is inserted within and wholly contained and hidden within said cavity and selectively removed from said cavity only through an anus portion of said bear, a locking assembly which selectively and removably contains said generally hollow cylinder within said containment cavity; and a message which is removably inserted into said generally hollow cylinder.

9. The message delivery assembly of claim 8 wherein said locking assembly comprises a key having a first end which cooperates with said locking assembly to allow removal of said generally hollow cylinder from said containment cavity and a second end of a certain shape.

10. The message delivery assembly of claim 9 wherein a second end of said key is heart shaped.

11. The message delivery assembly of claim 9 wherein said generally hollow cylinder further comprises at least one outwardly projecting fastening tab, and wherein said containment cavity further comprises at least one inwardly projecting fastening tab which frictionally couples to said outwardly projecting fastening tab of said cylinder, effective to removably couple said cylinder to said cavity.

12. A message delivery assembly comprising:

a body which is shaped as a bear, said body having a head portion, a torso portion, a pair of arms, and a pair of legs, said torso portion having a containment cavity which extends from between said pair of legs to the center of said torso portion;

a generally hollow cylinder which is removably inserted into said containment cavity, said generally hollow cylinder having a threaded aperture, a threaded aperture cover which cooperates with said threaded aperture, and a locking assembly;

a message which is removably inserted into said generally hollow cylinder through said threaded aperture;

a key comprising a first end which cooperates with said locking assembly to allow removal of said generally hollow cylinder from said containment cavity and a second end of a certain shape; and a fastening assembly which selectively and removably holds said key to said torso portion, and wherein said fastening assembly comprises a heart shaped patch having a ribbon which is sewn onto said heart shaped patch and which is effective to securingly contain said key, said heart shaped patch being sewn onto said torso portion.

* * * * *